US008205851B2

(12) United States Patent
Hebert

(10) Patent No.: US 8,205,851 B2
(45) Date of Patent: Jun. 26, 2012

(54) APPARATUS FOR HOLDING SUBSTANTIALLY CYLINDRICALLY SHAPED ELEMENTS

(76) Inventor: Vincent Hebert, Quebec (CA)

( * ) Notice: Subject to any disclaimer, the term of this patent is extended or adjusted under 35 U.S.C. 154(b) by 359 days.

(21) Appl. No.: 12/520,201

(22) PCT Filed: Dec. 21, 2007

(86) PCT No.: PCT/CA2007/002353

§ 371 (c)(1),
(2), (4) Date: Jun. 19, 2009

(87) PCT Pub. No.: WO2008/074159

PCT Pub. Date: Jun. 26, 2008

(65) Prior Publication Data

US 2010/0019119 A1 Jan. 28, 2010

Related U.S. Application Data

(60) Provisional application No. 60/871,345, filed on Dec. 21, 2006.

(51) Int. Cl.
*A47G 33/12* (2006.01)

(52) U.S. Cl. ..... 248/523; 248/525; 248/526; 47/40.5

(58) Field of Classification Search ..... 248/521, 248/523, 524, 526, 519, 525, 527, 346.03, 248/346.06, 311.2, 313, 314; 40/40.5
See application file for complete search history.

(56) References Cited

U.S. PATENT DOCUMENTS 649,785 A 5/1900 Weinert
2,464,593 A * 3/1949 Lorenzen ..... 47/40.5
2,504,455 A 4/1950 Ruetz
3,885,763 A * 5/1975 Blom ..... 47/40.5
4,061,306 A * 12/1977 Taylor ..... 248/523
(Continued)

FOREIGN PATENT DOCUMENTS

CA 2025783 3/1991
(Continued)

OTHER PUBLICATIONS

European Patent Application No. 07855633.9 Search Report dated Dec. 21, 2010.

(Continued)

*Primary Examiner* — Terrell McKinnon
*Assistant Examiner* — Ingrid M Weinhold
(74) *Attorney, Agent, or Firm* — Curtis B. Behmann; Borden Ladner Gervais LLP

(57) ABSTRACT

A self-adjusting apparatus is provided for clamping and supporting a substantially cylindrical element. When an element is placed in the self-adjusting apparatus, the element is supported at about 90° from the surface on which the apparatus sits. This is achieved with an integrated clamping mechanism and, preferably, with a self-centering mechanism comprising flexure springs and a retaining-center pin. The clamping mechanism applies a substantially radial force on the element that is directly proportional to the substantially cylindrical element's weight, and can be less than the weight of the element, preventing damage to the element. The present invention can include a liquid management system for when the apparatus supports a tree trunk. The liquid management system can include a reservoir, a funnel for filling the reservoir, a capillary wick and mat that provides water to the tree even when it is above the level of water in the reservoir.

23 Claims, 15 Drawing Sheets

U.S. PATENT DOCUMENTS

| | | | | | |
|---|---|---|---|---|---|
| 4,130,965 | A | * | 12/1978 | Patton et al. | 47/40.5 |
| 4,159,096 | A | * | 6/1979 | Chase | 248/523 |
| 4,541,601 | A | * | 9/1985 | Corbisello | 248/516 |
| 5,114,113 | A | * | 5/1992 | Krinner | 248/525 |
| 5,467,959 | A | * | 11/1995 | Behringer | 248/523 |
| 5,673,893 | A | * | 10/1997 | Klein | 248/525 |
| 5,791,626 | A | * | 8/1998 | Reese | 248/523 |
| 5,797,579 | A | | 8/1998 | Krinner | |
| 6,283,436 | B1 | * | 9/2001 | Schulz et al. | 248/523 |
| 6,681,519 | B2 | | 1/2004 | Cone | |
| 6,988,702 | B2 | * | 1/2006 | Schulz | 248/525 |
| 7,618,022 | B2 | * | 11/2009 | Thurner | 254/223 |

FOREIGN PATENT DOCUMENTS

| | | |
|---|---|---|
| CA | 2217958 | 1/1997 |
| DE | 29905427 U1 | 6/1999 |

OTHER PUBLICATIONS

PCT Patent Application No. PCT/CA2007/002353 International Search Report dated Apr. 17, 2008.

* cited by examiner

APPARATUS FOR HOLDING SUBSTANTIALLY CYLINDRICALLY SHAPED ELEMENTS

CROSS-REFERENCE TO RELATED APPLICATIONS

This application claims the benefit of priority of U.S. Provisional Patent Application No. 60/871,345 filed on Dec. 21, 2006, which is incorporated herein by reference in its entirety.

FIELD OF THE INVENTION

The present invention relates generally to an apparatus to support substantially cylindrical elements in a substantially vertical position. More particularly, the present invention relates to a self-adjusting apparatus for supporting a substantially cylindrical element, such as a cut tree, in a substantially vertical position.

BACKGROUND OF THE INVENTION

Stands for supporting trees and other substantially cylindrical elements are known in the art and numerous examples show the complexity of the mechanisms used to clamp and support a substantially cylindrical element. The mechanisms are varied, but are typically inconvenient as they require the user to crouch, kneel or lie on the ground and tighten the clamps at the same time as the user holds the element in a vertical position. Often, a second user is required to hold the element in a substantially vertical position while the first user tightens the clamps.

Some known approaches use the weight of the element to create a clamping force that is present as long as the element is in the apparatus. For example, U.S. Pat. No. 2,464,593 (Lorenzen) describes a tree holder in which the weight of the tree rests on a spring-supported conical cup, or retaining member. The displacement of the cup due to the weight of the tree causes knife-edge gripping blades to pivotally engage the tree trunk. U.S. Pat. No. 3,301,512 (Nyberg) describes a stand in which the weight of the element on a retaining member causes movable clamping arms to pivot and engage the tree trunk. U.S. Pat. No. 4,007,901 (Mancini) also describes a tree stand in which the weight of the element in a central reservoir, or retaining member, causes the legs to pivot and engage clamping arms with the tree trunk. Finally, U.S. Pat. No. 6,661,519 (Cone) describes an apparatus in which clamping arms pivot to engage a tree in response to the weight of the tree placed in a centrally disposed reservoir or retaining member.

In the references noted above, each apparatus describes the clamping arms as pivoting towards the tree trunk. The '519 patent to Cone further describes a locking mechanism to lock the clamping arms to the tree trunk. Each clamping mechanism is prevented from disengaging the tree trunk by the force generated by the weight of the tree on the retaining member. The force is transmitted to the tree trunk through the clamping arms pivoting on a fulcrum and engaging with the tree trunk. For a given weight of an element, the force applied by a pivoting clamping arm on the element depends on the diameter of the element, with large diameter elements experiencing greater applied forces than smaller diameter elements. This non-constant application of force on the element is a function of the amount of displacement of the clamping arms, and can damage the substantially cylindrical element being held.

It is therefore desirable to provide an apparatus with improved force characteristics to hold a substantially cylindrical element.

SUMMARY OF THE INVENTION

It is an object of the present invention to provide an improved apparatus which overcomes one or more deficiencies found in the prior art.

In an embodiment, the present invention provides a self-adjusting apparatus for holding a substantially cylindrical element in a substantially vertical position with respect to a surface of reference. The self-adjusting apparatus has a base for placement on the surface of reference and a receiving chamber attached to and extending upwardly from the base to define a receiving area for receiving the substantially cylindrical element. The receiving chamber defines an opening. The apparatus includes a retaining member for retaining a lower portion of the substantially cylindrical element within the receiving area. The retaining member is disposed within the receiving area and below the opening. The retaining member is vertically movable in response to receiving the substantially cylindrical element. The apparatus has a plurality of clamping mechanisms, each clamping mechanism coupled to the receiving chamber. Each clamping mechanism has a clamping arm moveable along a radial axis, the axis being below the opening and above the retaining member. The clamping mechanism has a cable system operatively connecting the clamping arm to the retaining member to automatically move the clamping arm from a rest position to a clamping position in response to downward vertical displacement of the retaining member. The apparatus clamps the substantially cylindrical element in the substantially vertical position.

In the absence of an externally applied force, the clamping arm can exert a clamping force on the substantially cylindrical element that is directly proportional to the weight of the substantially cylindrical element. In some embodiments, for a given weight of the element and in the absence of any externally applied force, the clamping arm can exert a substantially constant clamping force on the substantially cylindrical element irrespective of the clamping position. The clamping force can be less than or equal to a downward force due to the weight of the substantially cylindrical element on the retaining member. The clamping force can be between about 0.002 and about 0.6 times the weight of the substantially cylindrical element on the retaining member.

The clamping mechanism can include two cooperating elements which exert a variable frictional force on each other in order to prevent the clamping mechanism from unclamping in response to a substantially horizontal external force applied to the substantially cylindrical element.

The clamping arm can be a threaded clamping arm and the clamping mechanism can also includes a threaded cylinder. In such an apparatus, the frictional force is between the threaded clamping arm and the threaded cylinder. When the frictional force is between the threaded clamping arm and the threaded cylinder, the cable system includes a cable under tension and the frictional force can prevent the external force from affecting the magnitude of tension in the cable.

The clamping arm can be an unthreaded clamping arm and the cable system can also include a cable and a fixed pulley. In such an apparatus, the frictional force is between the cable and the fixed pulley. When the unthreaded clamping arm and cable system have a cable and fixed pulley, the cable system can include a first tension ($T_1$) in the portion of the cable between the unthreaded clamping arm and the fixed pulley; a second tension ($T_2$) in the portion of the cable between the fixed pulley and the retaining member; and the ratio between the first tension and second tension ($T_1/T_2$) can be between about 0.08 and about 0.00008.

The clamping mechanism can include a geared transmission to achieve a desired amount of radial displacement of the clamping arm as a function of the amount of vertical displacement of the retaining member. When the clamping arm includes a geared transmission, the desired amount of radial displacement of the clamping arm can be between about 0.8 and about 1.2 times the vertical displacement of the retaining member.

The self-adjusting apparatus can have a flexure spring mechanism attached to the retaining member to center the substantially cylindrical element within the opening. The flexure spring mechanism can have a single ring-type member, or at least two flexure springs. The retaining member can further include a center pin located substantially in the center of the retaining member.

The clamping arms can be radially spaced substantially equally around the perimeter of the receiving chamber. The clamping arms can define a substantially circular opening whose radius is greater than the radius of the substantially cylindrical element. Embodiments of the apparatus can have three, four, or more clamping arms.

The self-adjusting apparatus can have a liquid management system when the substantially cylindrical element is a tree. The liquid management system can include a reservoir disposed below the opening and within the receiving area. The liquid management system can also have a funnel in liquid communication with the reservoir for filling the reservoir with liquid. The liquid management system can also have a means for indicating the level of liquid in the reservoir.

The liquid management system can have a capillary system for drawing liquid from a lower portion of the reservoir up to a portion of the reservoir above the retaining member when the level of liquid in the reservoir is below the retaining member.

In yet another embodiment, the present invention provides an self-adjusting apparatus with a plurality of posts. The posts are attached to and extending upwardly from the base. The posts define a receiving area for receiving the substantially cylindrical element, the receiving area defining an opening between upper ends of the plurality of posts. The clamping mechanisms are coupled to one of the plurality of posts.

When the apparatus has a plurality of posts, the number of clamping mechanisms can be equal to the number of posts, and each post can have one clamping mechanism coupled thereto. Each clamping arm can be integral with the post to which it is coupled. The plurality of posts can be integral with the receiving chamber.

In yet another embodiment, the present invention provides a self-adjusting apparatus where the clamping mechanism is operably connected to the retaining member and moves along a radial axis in response to downward vertical displacement of the retaining member.

The apparatus can be for holding a tree trunk. The tree trunk being held is often the tree trunk of a tree used for hanging decorations thereon, such as a Christmas tree.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Figure 1:
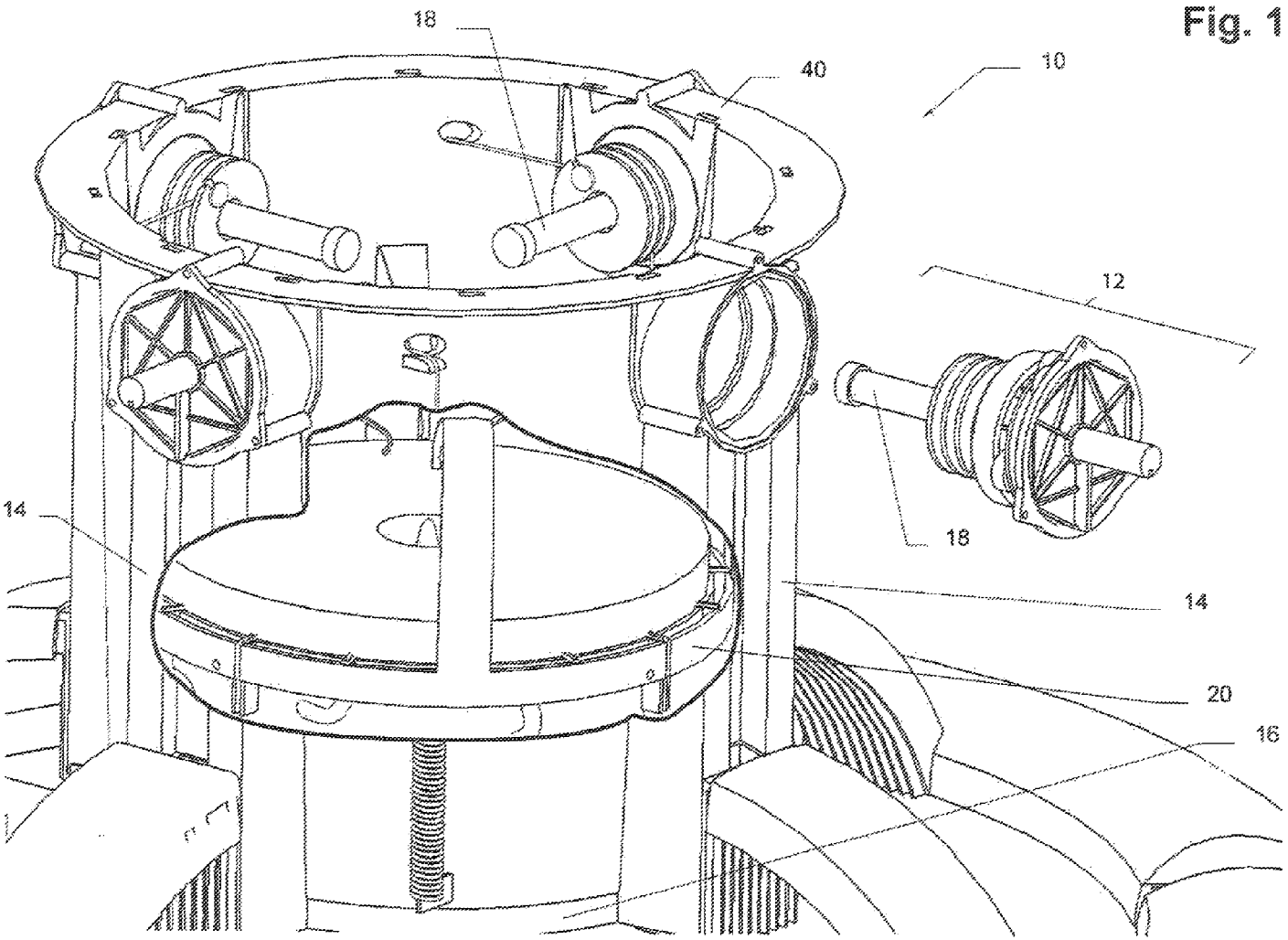
FIG. 1 illustrates a self-adjusting apparatus for holding a substantially cylindrical element according to a first embodiment of the present invention.

The terms "substantially cylindrical shaped element" and "substantially cylindrical element" are used interchangeably herein to represent a tree trunk, a branch, a pole, an umbrella, a coat tree, a coat peg or any other object having a substantially cylindrical shape, a slightly conical shape or any variant of these, etc. The term "tree trunk" can represent the trunk of a tree, a shrub, or any other living plant or tree.

The term "cable" is understood to be a row or string of elements united by, or as if by, braiding, twisting, twining or threading, and is also used herein to represent a chain; wire; rope; line; band; ribbon; strip; a slender, flexible, rod or narrow sheet; or any variant of these. In more mechanical terms, the term "cable" herein designates a component that exhibits relatively high stiffness when subjected to tension loads and relatively low stiffness when subjected to flexion loads. This characteristic implies that the component can be easily wound but is hard to stretch or elongate.

A new substantially cylindrical element supporter has been designed with the aim of improving the force characteristics exerted on the element by the self-adjusting apparatus of the present invention. The clamping force exerted by the clamping arm on the element can be directly proportional to the weight of the substantially cylindrical element.

The term "radial axis" is herein defined as an axis being substantially perpendicular to the substantially vertical center axis of a receiving area for receiving the substantially cylindrical element. Therefore, radial displacement is translational displacement along the radial axis and radial force is a force exerted along the radial axis.

The new substantially cylindrical element supporter has also been designed with the aim of modulating the force exerted on the element by the self-adjusting apparatus of the present invention. Self-adjusting apparatuses employing clamping arms with force amplifiers, using mechanical advantage such as pivots and fulcrums, can damage the elements to be supported. In the self-adjusting apparatus of the present invention, the magnitude of the force exerted by the clamping arm can be reduced.

Further, apparatuses of the present invention reduce the hassle related with the use of other products on the market today. With embodiments of the present invention, there is no need for the user to bend down or to get on his/her knees to clamp the apparatus to the substantially cylindrical element or to refill it, etc.

An apparatus according to embodiments of the present invention can be provided for residential, commercial or industrial uses where it is desirable to clamp and support a substantially cylindrical element in a substantially vertical position.

Generally, the present invention provides a self-adjusting apparatus for clamping and supporting a substantially cylindrical element. When an element is placed in the self-adjusting apparatus, the element is supported at about 90° from the surface on which the apparatus sits. This is achieved with an integrated clamping mechanism and, preferably, with a self-centering mechanism comprising flexure springs and a retaining-center pin. The clamping mechanism applies a substantially radial force on the element that is directly proportional to the substantially cylindrical element's weight, and can be less than the weight of the element, preventing damage to the element. The present invention can include a liquid management system for when the apparatus supports a tree trunk. The liquid management system can include a reservoir, a funnel for filling the reservoir, a capillary wick and mat that provides water to the tree even when it is above the level of water in the reservoir.

PARTS IDENTIFICATION

Figure 15:
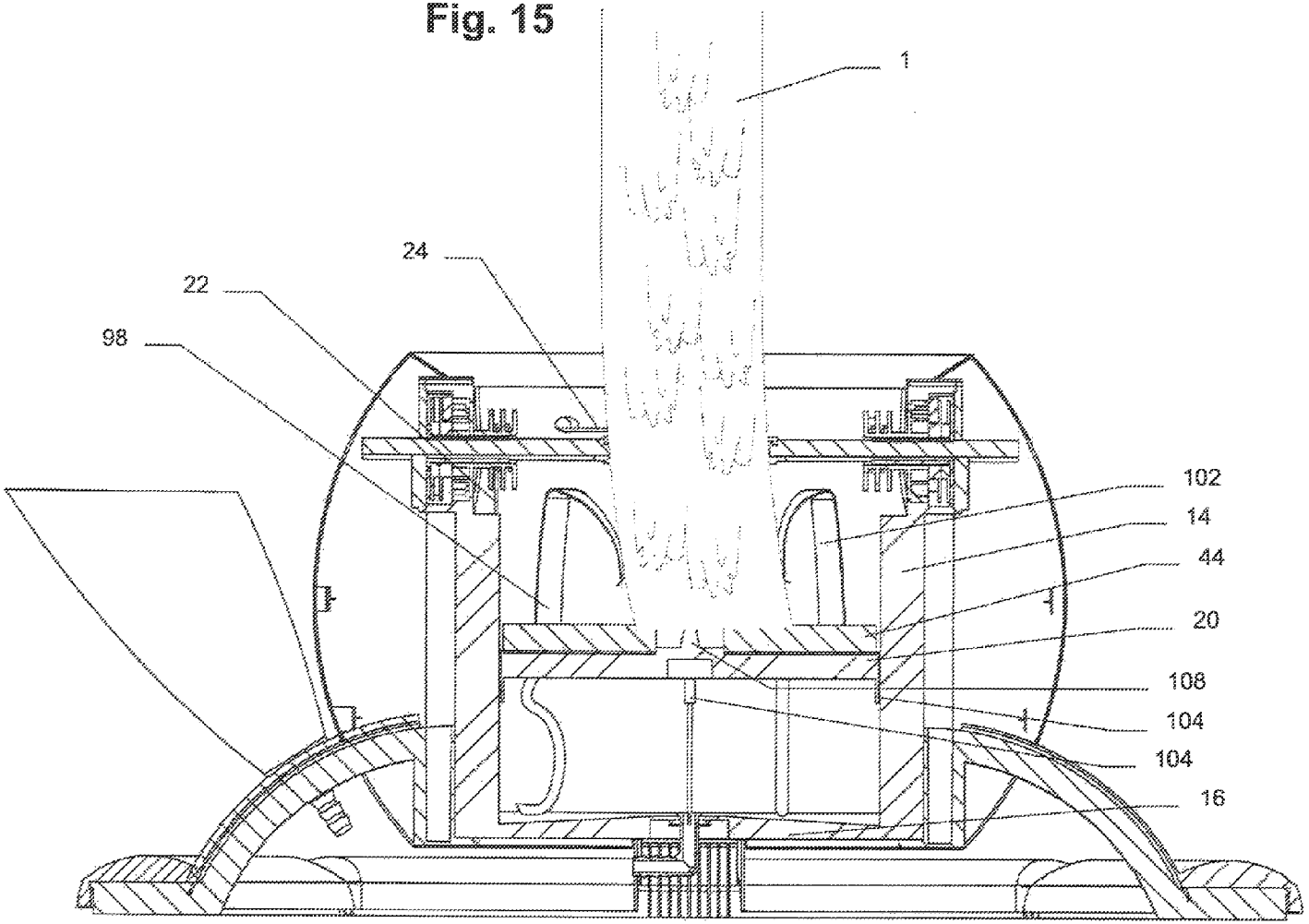
FIG. 15 illustrates a crooked or curvy substantially cylindrical element in place in a self-adjusting apparatus according to a first embodiment of the present invention.

1 Substantially cylindrical element
10 Self-adjusting apparatus of the first embodiment
12 Clamping mechanism
14 Post of the first embodiment
16 Base of the first embodiment
18 Threaded clamping arm
20 Retaining member
22 Clamping cable
24 Rewinding cable
26 Pulley
28 Cable end fitting
30 Recall spring
32 Ring gear
34 Shell of the first embodiment
36 Leg of the first embodiment
38 Foot of the first embodiment
40 Reservoir
42 Funnel
44 Capillary mat
46 Capillary wick
48 Capillary mat and wick combination
50 Capillary mat spring
52 90° hose plug
54 Indexing groove
56 Clamping arm stopper
58 Cap
60 Indexing pin
62 First stage sun gear and second stage planet carrier
64 First stage planet gear
66 First stage planet carrier
68 Second stage sun gear and third stage planet carrier
70 Third stage sun gear
72 Second stage planet gear
74 Third stage planet gear
76 Threaded cylinder
78 Self-adjusting apparatus of the second embodiment
80 Clamping mechanism of the second embodiment
82 Post of the second embodiment
84 Base of the second embodiment
86 Un-threaded clamping arm
88 Shell of the second embodiment
90 Leg of the second embodiment
92 Foot of the second embodiment
94 Funnel holder
96 Return spring
98 Fixed pulley
100 Un-threaded clamping arm guide
102 Flexure spring
104 Gliders
106 Small rod
108 Retaining member center pin FIG. 1 illustrates a first embodiment of a self-adjusting apparatus 10 including a clamping mechanism 12 for holding a substantially cylindrical element 1 (shown in FIG. 15). A receiving chamber extends upwardly from base 16. The clamping mechanism 12 can be coupled to the receiving chamber. The clamping mechanism 12 of the embodiment illustrated in FIG. 1 is coupled to one of a plurality of posts 14. The posts in FIG. 1 are attached to and extend upwardly from the base 16 and are integral with the receiving chamber. The clamping mechanism 12 can be located at the upper ends of one of the plurality of posts 14, as shown in FIG. 1. In an alternative embodiment (not shown), the clamping mechanism 12 can be coupled to a receiving chamber that does not include a post. The receiving chamber, whether having integral posts, as illustrated in FIG. 1, or lacking posts defines a receiving area for receiving a substantially cylindrical element. The receiving chamber further defines an opening at an upper edge thereof. The receiving chamber has a diameter appropriate for receiving the diameter of a substantially cylindrical element typically used in a given application. An embodiment of the present invention can have at least one clamping mechanism coupled to the receiving chamber. The clamping mechanism 12 in the embodiment of FIG. 1 comprises a threaded clamping arm 18 or screw. A force applied to the threaded clamping arm 18 is imparted by the weight of the substantially cylindrical element on a retaining member 20 and activates the threaded clamping arm 18 or screw. The retaining member 20 is located within the receiving area of the receiving chamber and below the opening.

In an embodiment, the present invention comprises posts (each having a clamping mechanism coupled thereto) that are radially spaced substantially equally around the base member and defining an opening. The opening, for example a circular opening, has a diameter appropriate for receiving the diameter of a substantially cylindrical element typically used in a given application. In such instances, the radius of the opening can be greater than the radius of the substantially circular element. However, in another embodiment, the posts have clamping mechanisms that are spaced unequally around the base member. In that case, the clamping arms associated with the clamping mechanisms exert forces that engage the substantially cylindrical element with a post lacking a clamping mechanism. In various embodiments, the posts, both those having and those lacking clamping mechanisms, can be spatially adjustable on the base.

Although the clamping mechanisms can be coupled to fixed posts that displace a movable clamping arm, in a further embodiment the post and clamping arms are integral with one another, and the post and clamping arm are operably connected by a clamping mechanism to the retaining member. In various embodiments of the present invention, the apparatus can have three or four clamping arms. An apparatus can also have more than four clamping arms.

Figure 2:
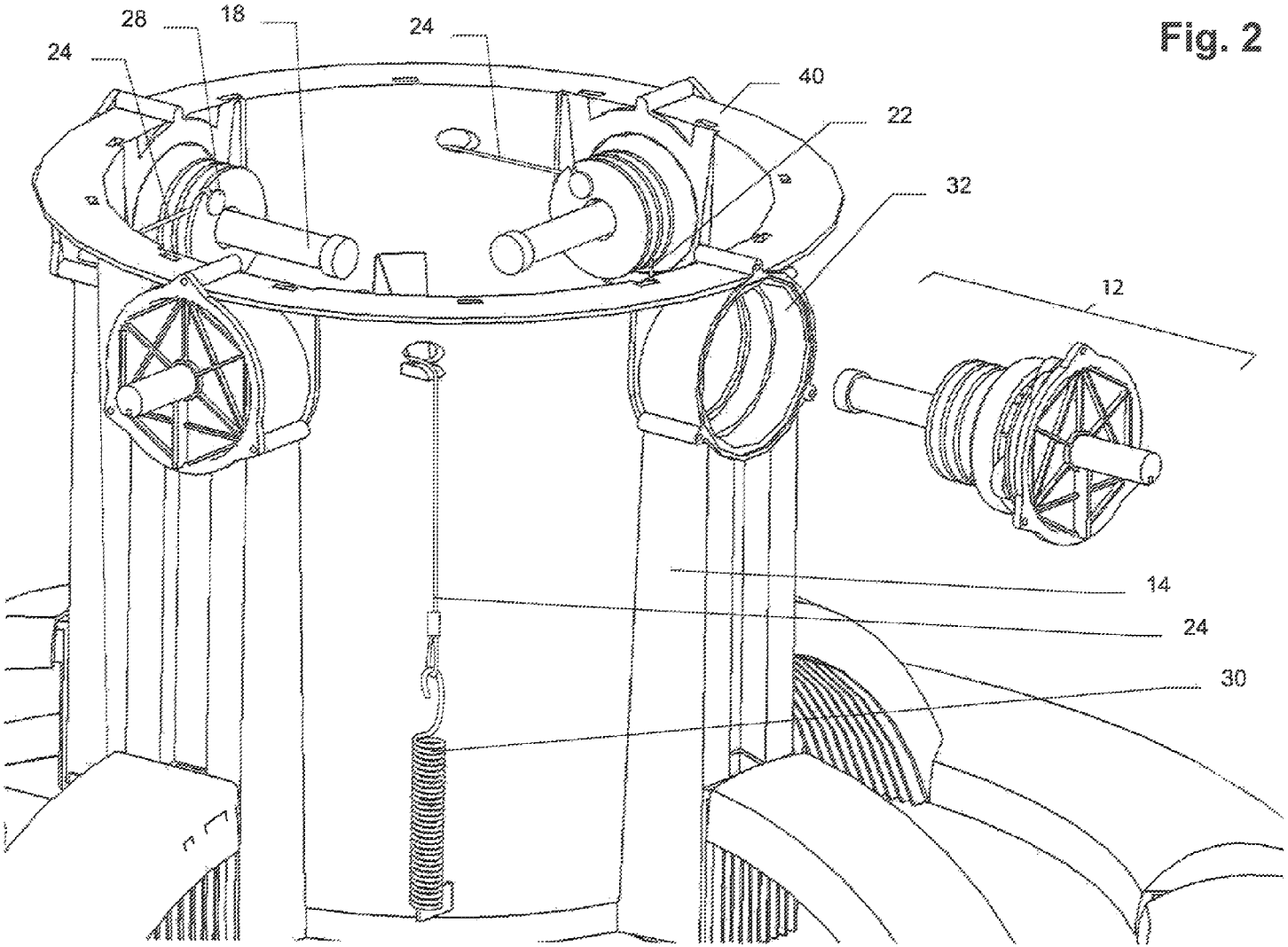
FIG. 2 illustrates various additional elements of the self-adjusting apparatus of FIG. 1.

FIG. 2 further depicts various preferred components of the self-adjusting apparatus 10 and clamping mechanism 12 of the first embodiment. Two cables, a clamping cable 22 and a rewinding cable 24 are attached to a pulley 26 which has two cavities to enroll the cables. The cables 22 and 24 are joined at a first end thereof to the pulley 26 by a cable end fitting 28. In the first embodiment, the other end of each cable is a loop. The clamping cable 22 is joined to the retaining member 20, shown in FIG. 1. The rewinding cable 24 connects the pulley 26 to a recall spring 30. The rewinding cable 24 and recall spring 30 rewind the threaded clamping arm 18 to its starting position, or rest position, when the weight of the substantially cylindrical element 1, not shown, is removed from the retaining member 20, shown in FIG. 1.

In the mechanism's starting position, or rest position, the retaining member 20 is typically at its highest possible position. The mechanism's maximum ending position is typically the configuration in which the retaining member 20 is at its lowest possible position when no substantially cylindrical element is being retained. The mechanism's clamping position is typically the configuration in which the threaded clamping arm 18 is engaged with the substantially cylindrical element and the retaining member 20 is at a position between the highest and lowest possible positions. In the rest position, the clamping arm can be prevented from moving radially outward by the post to which the clamping mechanism is engaged. In another embodiment, the starting or rest position of the clamping arm can be settable such that the opening defined by the portions of the clamping arms that engage the substantially cylindrical element is different than the opening defined by the posts to which the clamping mechanisms are connected. The internal elements of clamping mechanism 12 rotate relative to a fixed ring gear 32.

Figure 3:
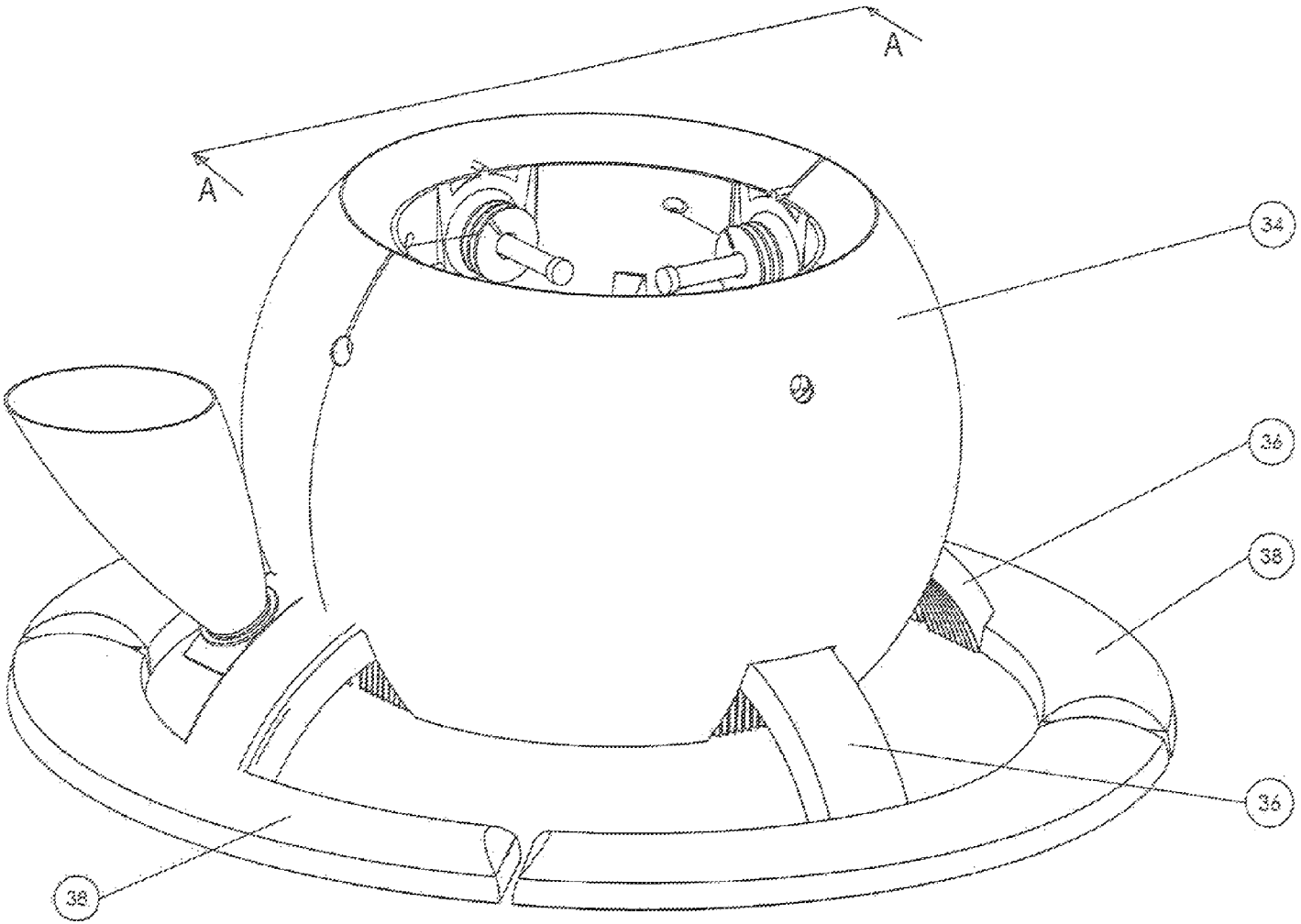
FIG. 3 illustrates the self-adjusting apparatus of FIG. 2 further including a shell and support elements

FIG. 3 further illustrates an embodiment in which the self-adjusting apparatus 10 includes a shell 34. The shell 34 preferably covers the functional parts of the self-adjusting apparatus. The purpose of the shell 34 is to allow a more esthetically pleasing look to the self-adjusting apparatus of the present invention. In other words, the shell 34 brings an appealing esthetic value to the present invention. Both embodiments described herein are preferably supported by a base. The base 16 (shown in FIG. 1) can be provided within the shell, or can be integral with the shell. In an embodiment where the base is not integral with the shell, the shell can be placed around the functional parts of the self-adjusting apparatus during a final stage of production, allowing for a variety of shells to be applied to the same functional parts of the self-adjusting apparatus to provide products of varying styles, construction and sophistication.

Since the center of mass of the substantially cylindrical element may be far from the surface of reference on which the apparatus rests, it is important to stabilize the self-adjusting apparatus that clamps the substantially cylindrical element. The self-adjusting apparatus is more stable the further the contact point(s) is (are) from the main axis of the substantially cylindrical element, as long as the center mass of the substantially cylindrical element is located somewhere along the center axis of the self-adjusting apparatus. The base 16 or shell 34 of the present invention can have one or more contact surfaces(s) with the ground. The base 16 or shell 34 can comprise at least one leg 36 and one foot 38. The leg 36 and foot 38 can be provided as separate elements, or be provided integral with one another.

In various embodiments of the present invention, the base, foot or leg can include a fastening means to secure the base to the surface of reference. Such fastening means include bolts, screws, or any other means known in the art to removably attach the apparatus to the surface of reference.

Figure 4:
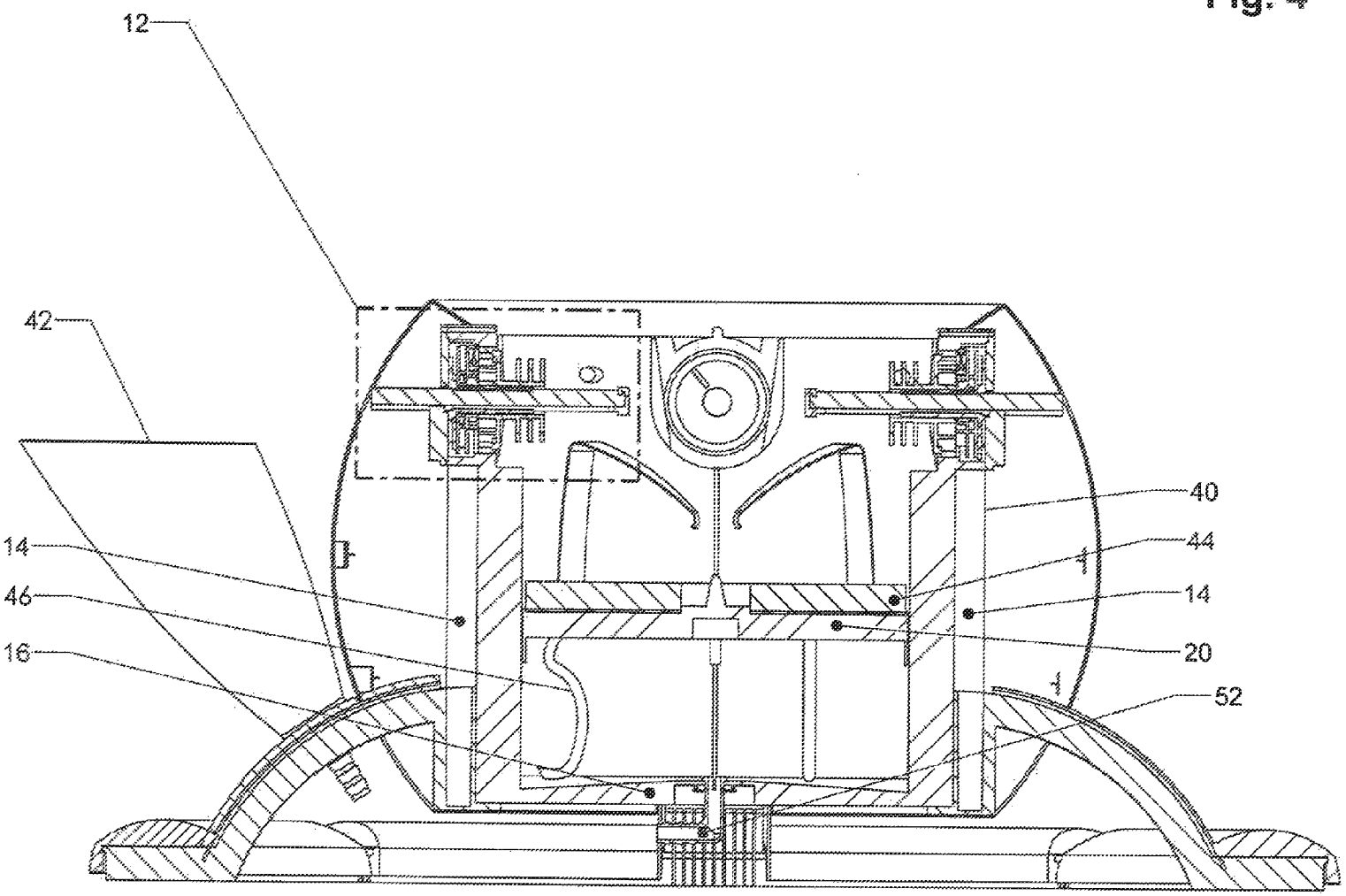
FIG. 4 is a complete section view of the self-adjusting apparatus of FIG. 3 taken along the line A-A and showing elements of a liquid management system.

In some cases, such as when the substantially cylindrical element is a trunk of a live tree, there is a need for the substantially cylindrical element to be nourished by a liquid, such as water. FIG. 4 is a complete section view of the self-adjusting apparatus of FIG. 3 taken along the line A-A and showing elements of a liquid management system. Presently preferred components of the liquid management system can be seen in FIG. 4. The liquid management system can comprise a liquid reservoir 40 defining an area for holding liquid, the liquid reservoir being in liquid communication with the substantially cylindrical element. In the embodiment of FIG. 4, the reservoir is defined by the base 16, posts 14, and walls connecting the base 16 and posts 14. In the embodiment illustrated in FIG. 3, the receiving chamber is integral with the liquid reservoir 40. Alternatively, the reservoir can be defined by a base and wall that are not integral with the base 16 or posts 14.

A funnel 42 can make it easier for the user to fill the reservoir 40 with liquid. The opening of the funnel 42 is preferably placed away from the reservoir 40. This makes it possible for the user to avoid bending down or getting on his/her knees to fill the reservoir 40. The funnel 42 can also indicate a liquid level in the reservoir 40. One line or indicator can be provided on a substantially transparent or substantially translucent funnel 42 to indicate the liquid level at which the reservoir is full and another line to indicate the level when the reservoir 40 is considered empty, or requiring extra liquid. These lines are provided so that they overlay the line naturally created by the liquid level when the funnel 42 is in its planned position of use.

The retaining member 20, which is engaged with the substantially cylindrical element, is at a distance from the bottom of the reservoir 40. This can result in a volume of liquid not contacting the substantially cylindrical element 1. In the embodiment of FIG. 4, a capillary feeding system is provided to bring liquid from the bottom of the reservoir 40 up to the substantially cylindrical element resting on the retaining member 20. In this manner, liquid contained by the reservoir 40 can be brought to and absorbed by the substantially cylindrical element. This capillary system can include a capillary mat 44 to cover the area of the retaining member 20 and spread out the liquid. One or more wick(s) 46, in liquid communication with the capillary mat 44, bring liquid up to the capillary mat 44 by capillary action. The capillary wick 46 preferably comprises small fibers maintained one against the others. This creates small gaps between each fiber, which act like small tubes. These small tubes rely on the surface tension of the liquid to raise the liquid against gravity. A portion of the capillary wick 46 preferably extends to the bottom of the reservoir so that it is covered by the liquid.

The capillary feeding system can be used so that a substantially cylindrical element receives its needed liquid, no matter the diameter of the element. The capillary mat 44 is preferably positioned between the top of the retaining member 20 and the bottom of the substantially cylindrical element. In this manner, the capillary mat 44 can provide liquid to the substantially cylindrical element even when there is no portion of the substantially cylindrical element is submerged in the liquid in the reservoir.

A 90° hose plug 52 is engaged with the bottom of the reservoir 40. The 90° hose plug can be self-sealing and allows the funnel 42 to be in liquid communication with the reservoir 40. When engaged with the reservoir 40, the flexible lip of the hose plug 52 gets pressed against the exterior surface of the reservoir's 40 bottom, which forms a tight seal. In an alternate embodiment, the 90° hose plug can be provided as a different type of plug performing substantially similar functions.

Figure 5:
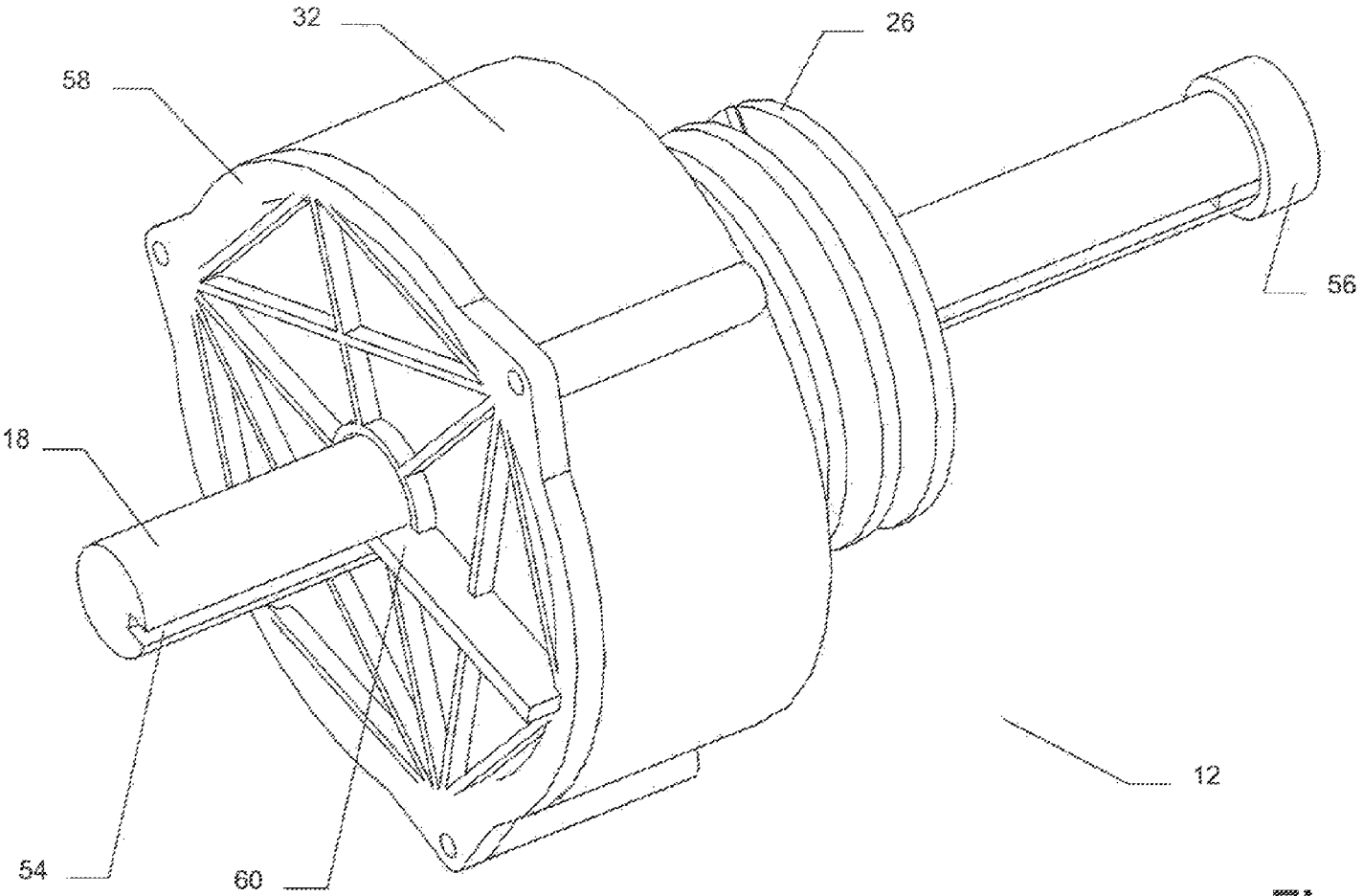
FIG. 5 illustrates a clamping mechanism according to an embodiment of the present invention including a geared transmission.

FIG. 5 illustrates a clamping mechanism according to an embodiment of the present invention including a geared transmission A geared transmission can be used to achieve a desired radial displacement of the threaded clamping arm 18 in relation to the vertical displacement of the retaining member 20. A geared transmission can also be used to achieve a desired force exerted by the threaded clamping arm 18 on the substantially cylindrical element. According to various embodiments of the present invention, the geared transmission is used to convert an input force into a smaller output force. In such embodiments, the geared transmission can increase the number revolutions of the threaded clamping arm 18 for a given number of revolutions of the pulley 26.

The geared transmission can be a planetary geared transmission, epicyclic geared transmission or Ravigneaux geared transmission, or any other suitable type of geared transmission. The transmission compensates for the pitch of the threaded clamping arm 18. For instance, if threaded clamping arm 18 has a given pitch of P (P being a variable equivalent to the number of threads per unit of arm length), more vertical displacement of the retaining member 20 (represented by the variable V) might be needed than is available, based on the dimensions of the apparatus, in order to obtain the necessary radial displacement (represented by the variable R) of the threaded clamping arm 18 to engage with the substantially cylindrical element 1.

An equation relating the pulley circumference (C), the pitch (P), and vertical displacement (V) to radial displacement (R) is shown in Equation 1:

$$(G)/(C*P)=(R/V) \qquad \text{Equation 1:}$$

Where: $C=2*\pi*r$ $\pi$ (pi) is about equal to 3.141590 r is the radius of the pulley

G is the gear ratio of the geared transmission

Equation 1 shows that the radial displacement (R) of the threaded clamping arm is a function of the vertical displacement (V) of the retaining member, pulley radius (r), thread pitch (P) and gear ratio (G). Without a geared transmission, the necessary vertical displacement (V) to achieve a desired radial displacement (R) could, in some instances, be too large for the dimensions of the self-adjusting apparatus. Changing the gear ratio (G), using the geared transmission described above, changes the amount of vertical displacement (V) necessary to achieve a desired radial displacement (R). From Equation 1, it is apparent that increasing the output/input ratio (G) of the geared transmission results in less vertical displacement (V) needed to effect the same radial displacement (R). Further, changing the gear ratio can change the magnitude of force imparted by the clamping mechanism. Increasing the output/input ratio (G) of the geared transmission results in less force on the substantially cylindrical element for a given weight on the retaining member.

FIG. 5 depicts one embodiment of the clamping mechanism 12 in assembled form. The threaded clamping arm 18 is illustrated to have an indexing groove 54 and clamping arm stopper 56. The threaded clamping arm 18 passes through the ring gear 32, cap 58 and pulley 26. An indexing pin 60 is attached to the cap 58. The threaded clamping arm 18 can be prevented from spinning because it is retained by the indexing pin 60 built into the cap 58. The indexing pin 60 fits in the indexing groove 54 machined in the threaded clamping arm 18 and constrains the threaded clamping arm 18 to move along its axis, forward or backward. The clamping arm stopper 56 prevents the threaded clamping arm 18 from being removed from the ring gear 32, cap 58 and pulley 26.

Figure 6:
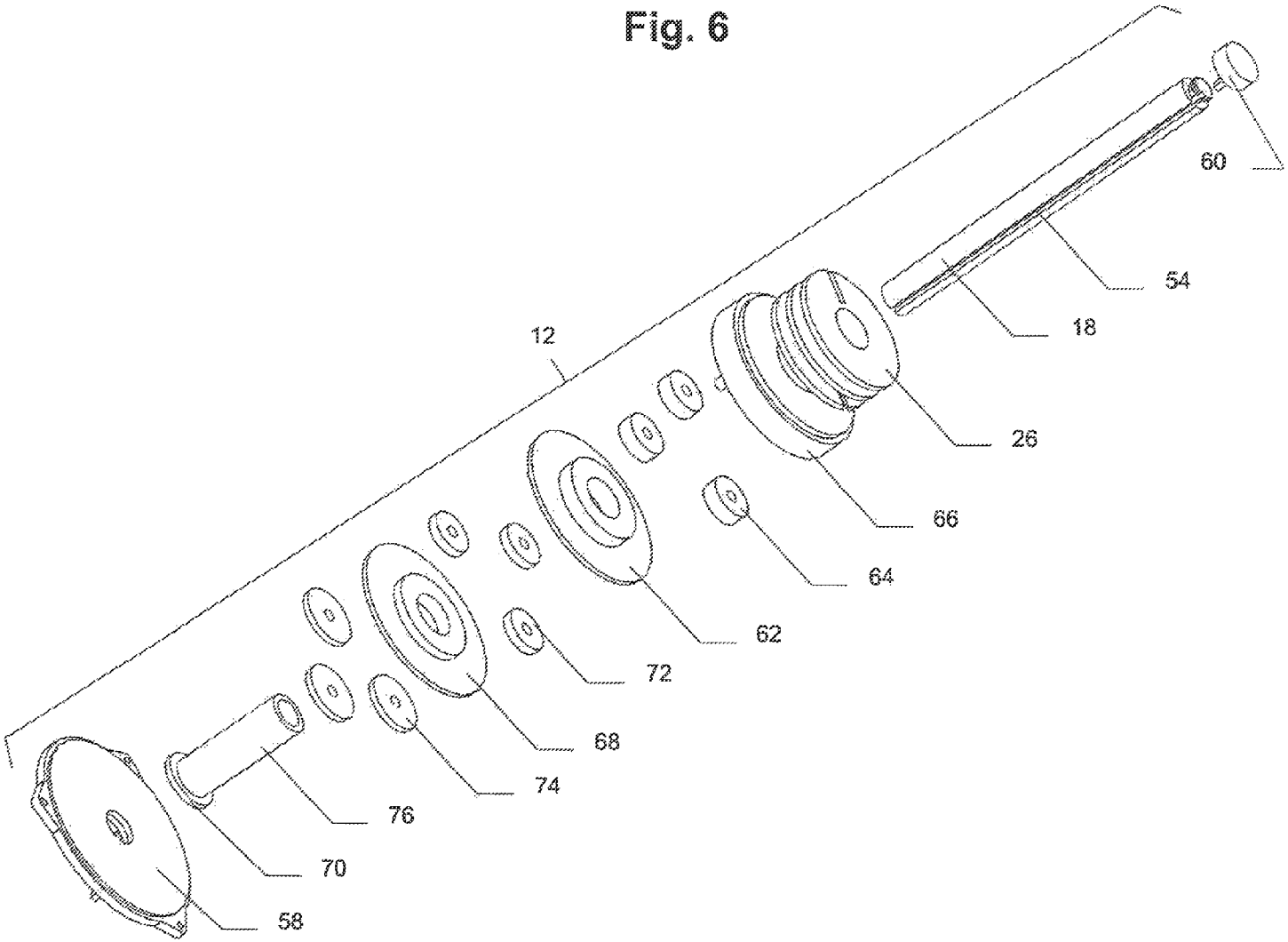
FIGS. 6 and 7 illustrate different exploded views of a clamping mechanism according to a first embodiment of the present invention.
Figure 7:
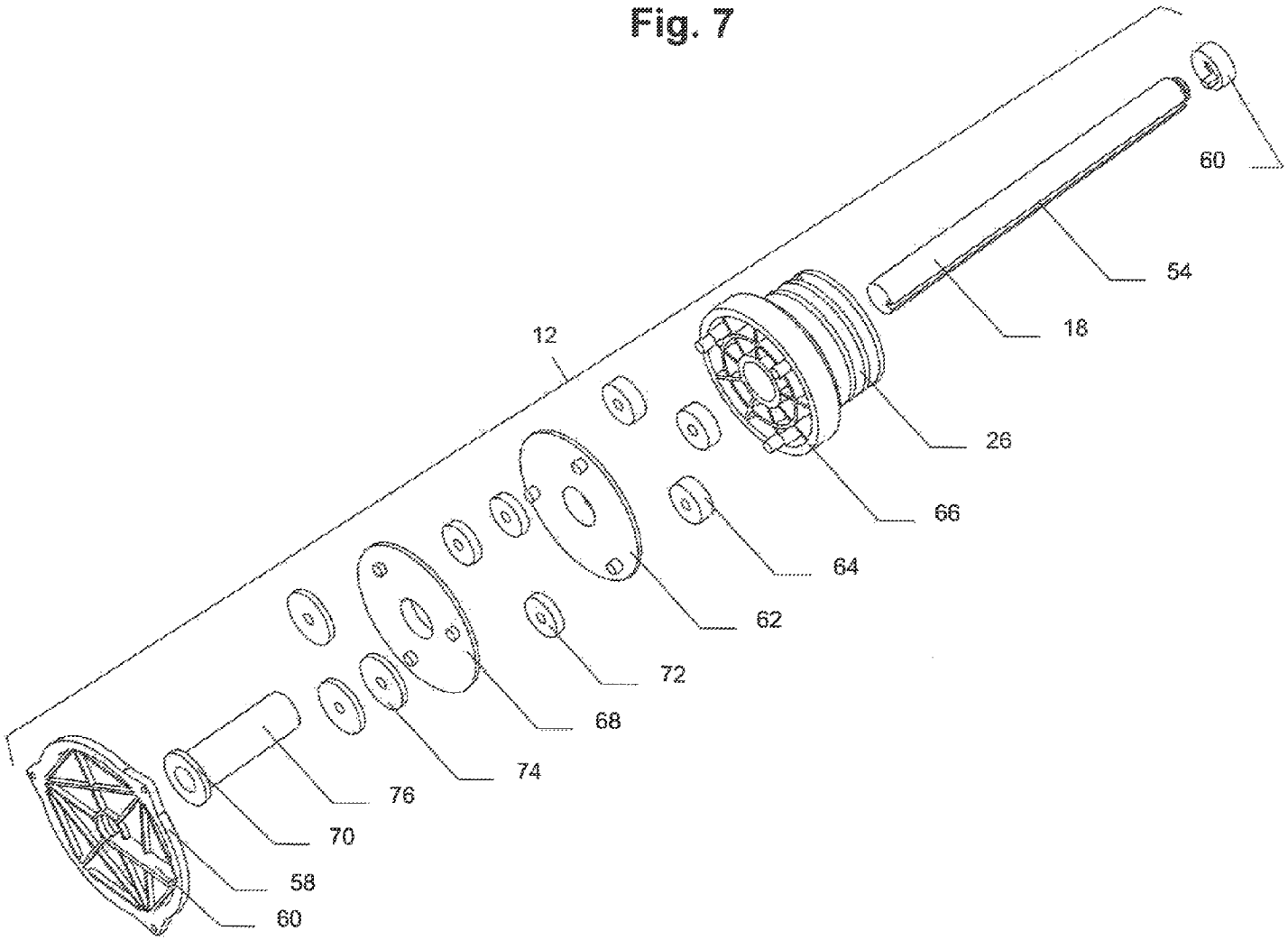

FIGS. 6 and 7 illustrate exploded views of the clamping mechanism, from two different perspectives. The geared transmission of the first embodiment is depicted in FIGS. 6 and 7, and comprises an assembly of, at least, one sun gear 62, one planet gear 64, supported by a planet carrier 66, and a ring gear or annulus gear 32, shown in FIG. 2. For one set of sun/planet/carrier/ring gears (referred to collectively as a stage), a certain gear ratio is achievable. Since the threaded clamping arm 18 passes through the center of the transmission, the diameter of the sun gear 62 is constrained, limiting the gear ratio range available with one stage. Additional stages can be provided in order to achieve a desired gear ratio. Modifying the gear ratio changes the overall transmission ratio, which is the ratio between the vertical displacement (V) of the retaining member 20 and the radial displacement (R) of the threaded clamping arm 18. In various embodiments, it is desirable to have a gear ratio that results in a transmission ratio of R/V between about 0.8 and about 1.2.

The gears of additional stages are illustrated in FIGS. 6 and 7. Sun gears 68 and 70, planet gears 72 and 74 and planet carriers 62 and 66 are shown. In a presently preferred embodiment, the first stage sun gear and the second stage planet carrier constitute only one part 62, i.e. are integral with one another. Likewise, the second stage sun gear and the third stage planet carrier 66 are integral with each other. The sun gears 62, 66 and 70, planet gears 64, 72 and 74, and planet carriers 62 and 66 are placed inside the ring gear 32 and engage with a threaded cylinder 76, through which the threaded clamping arm 18 runs.

The sun gear 62 is the central gear of the system, while the planet gear 64 is a gear revolving around the sun gear 62. The planet carrier 66 carries one or more planet gears, such as planet gears 64, 72 and 74. The ring gear 32 is the outer gear with teeth facing inward, facing its revolving axis and meshing with the gear teeth of the planet(s).

In the operation of the first embodiment, at least one threaded clamping arm 18 is displaced by at least one clamping mechanism 12, which preferably comprises a geared transmission, activated by the weight of the substantially cylindrical element 1 on the retaining member 20. The clamping mechanism 12 activates and clamps the threaded clamping arm 18 to engage the clamping arm 18 with the substantially cylindrical element 1. The clamping cable 22 transmits the force generated by the weight of the substantially cylindrical element 1 to the threaded clamping arm 18 by way of the pulley 26. The pulley 26 converts the vertical movement of the retaining member 20 into rotational movement of the geared transmission, whose rotational output is the inner-threaded cylinder 76. The threaded cylinder 76 turns, activating the threaded clamping arm 18. Therefore, when the pulley 26 is activated by the displacement of the retaining member 20 towards the surface of reference, the threaded clamping arm 18 is displaced radially inward until it engages the substantially cylindrical element 1 placed within the self-adjusting apparatus 10.

The clamping mechanism described in the operation of the first embodiment exerts a clamping force based on the weight of the substantially cylindrical element on the retaining member. The downward force on the retaining member is transmitted by the cable and pulley through the clamping arm back to the substantially cylindrical element. The clamping force on the substantially cylindrical element is proportional to the weight of the substantially cylindrical element and, since the displacement of the clamping arm is in an essentially radial direction, the clamping force is directly proportional to the substantially cylindrical element's weight. In various embodiments, the clamping force is less than or equal to the force due to the weight of the substantially cylindrical element on the retaining member. The clamping force can be between about 0.002 and about 0.6 times the weight of the substantially cylindrical element on the retaining member.

In some embodiments, the clamping arm can exert a substantially constant clamping force regardless of the apparatus's clamping position. In such embodiments, for a given weight, the diameter of the substantially cylindrical element (and, hence, the position of the clamping arm when it engages with the substantially cylindrical element) does not affect the magnitude of the clamping force exerted by the clamping arm.

In the first embodiment, the self-adjusting mechanism is prevented from unclamping the substantially cylindrical element 1 when weight is placed on the retaining member 20. Once the threaded clamping arm 18 engages the substantially cylindrical element 1, the weight of the substantially cylindrical element 1 on the retaining member 20 prevents the threaded clamping arm 18 from disengaging the substantially cylindrical element 1. The more weight placed on the retaining member 20 by the substantially cylindrical element 1, the more forcibly the clamping arms 18 engage the substantially cylindrical element 1. In cases where the substantially cylindrical element is subjected to an externally applied horizontal force, the friction between the threaded clamping arm 18 and inner-threaded cylinder 76 prevents the threaded clamping arm 18 from moving radially. In these instances, since the threaded clamping arm 18 does not move, the tension in the cable 22 does not change and the retaining member 20 also does not move. Unlocking the presently preferred embodiment requires lifting the substantially cylindrical element 1 away from the surface of reference, thereby removing its weight from the retaining member 20.

Figure 8:
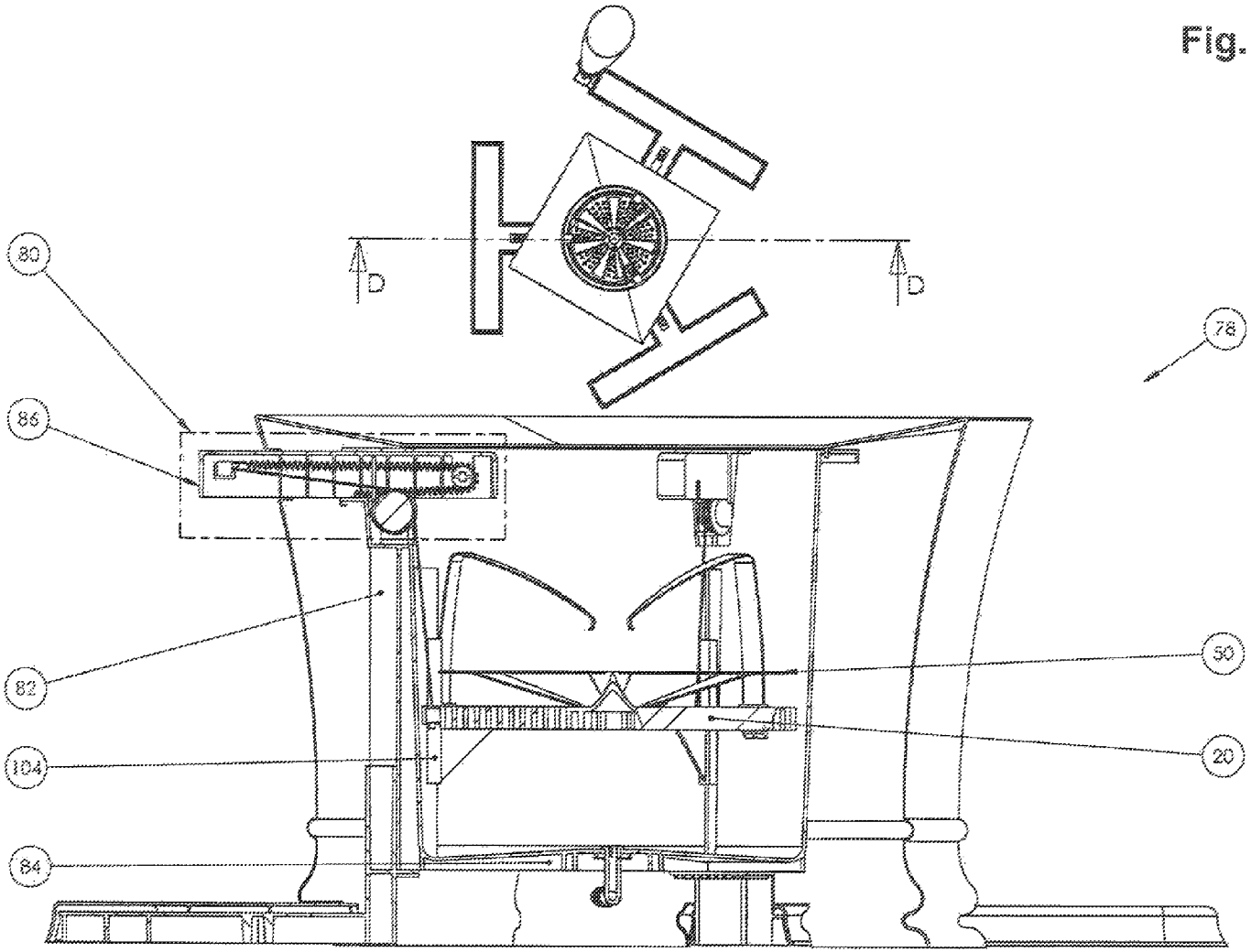
FIG. 8 illustrates a self-adjusting apparatus for holding a substantially cylindrical element according to a second embodiment of the present invention.

FIG. 8 illustrates a self-adjusting apparatus 78 and clamping mechanism 80 according to a second embodiment of the present invention. The clamping mechanism 80 is located at the upper ends of posts 82 that are attached to and extend upwardly from a base 84. The posts 82 define a receiving area for receiving a substantially cylindrical element placed between them. The receiving area defines an opening between the upper ends of the posts. The clamping mechanism 80 comprises an unthreaded clamping arm 86 that exerts a radial force inward on the substantially cylindrical element 1 (shown in FIG. 15). The radial force applied by the unthreaded clamping arm 86 is activated by the weight of the substantially cylindrical element 1 on the retaining member 20. The posts 82, the clamping mechanisms 80, and the receiving area in FIG. 8 can have varying features as described in relation to the posts 14, the clamping mechanism 12 and receiving area in FIG. 1.

Figure 9:
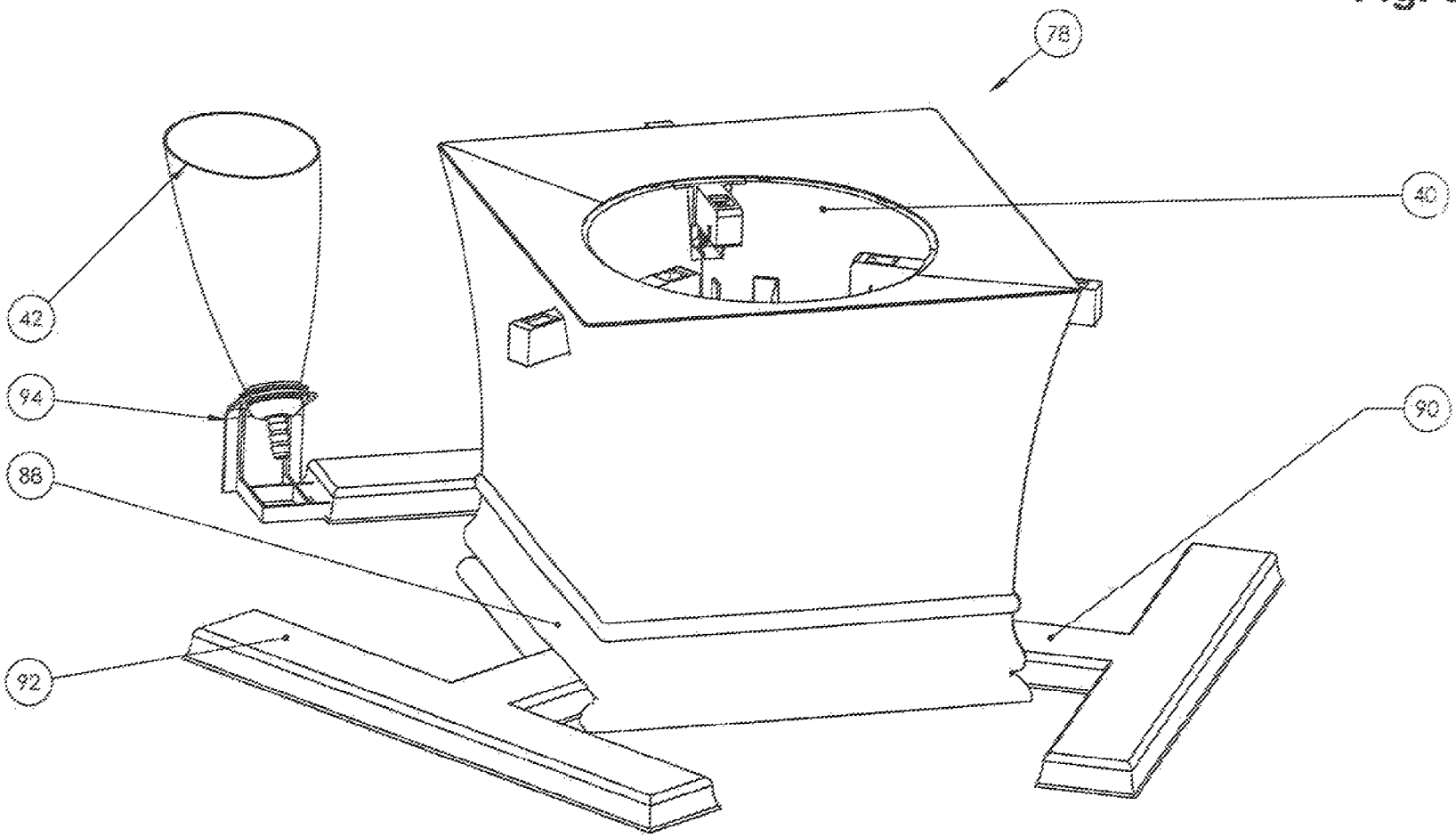
FIG. 9 illustrates the self-adjusting apparatus of FIG. 8 further including a shell and support elements.

The second embodiment of the present invention is further depicted in FIG. 9 which illustrates the self-adjusting apparatus 78 as having a shell 86, a leg 90, a foot 92, and a liquid management system, which is substantially similar to the liquid management system of the first embodiment and further comprises a funnel holder 94, by means of which the funnel 42 is engaged with the self-adjusting apparatus. The funnel holder 94 can be built into one of the legs 36 (or 90) or feet 38 (or 92), or can stand alone. In the second embodiment, the base 84, leg 90 and foot 92 are substantially similar to their respective counterparts in the first embodiment.

Figure 10:
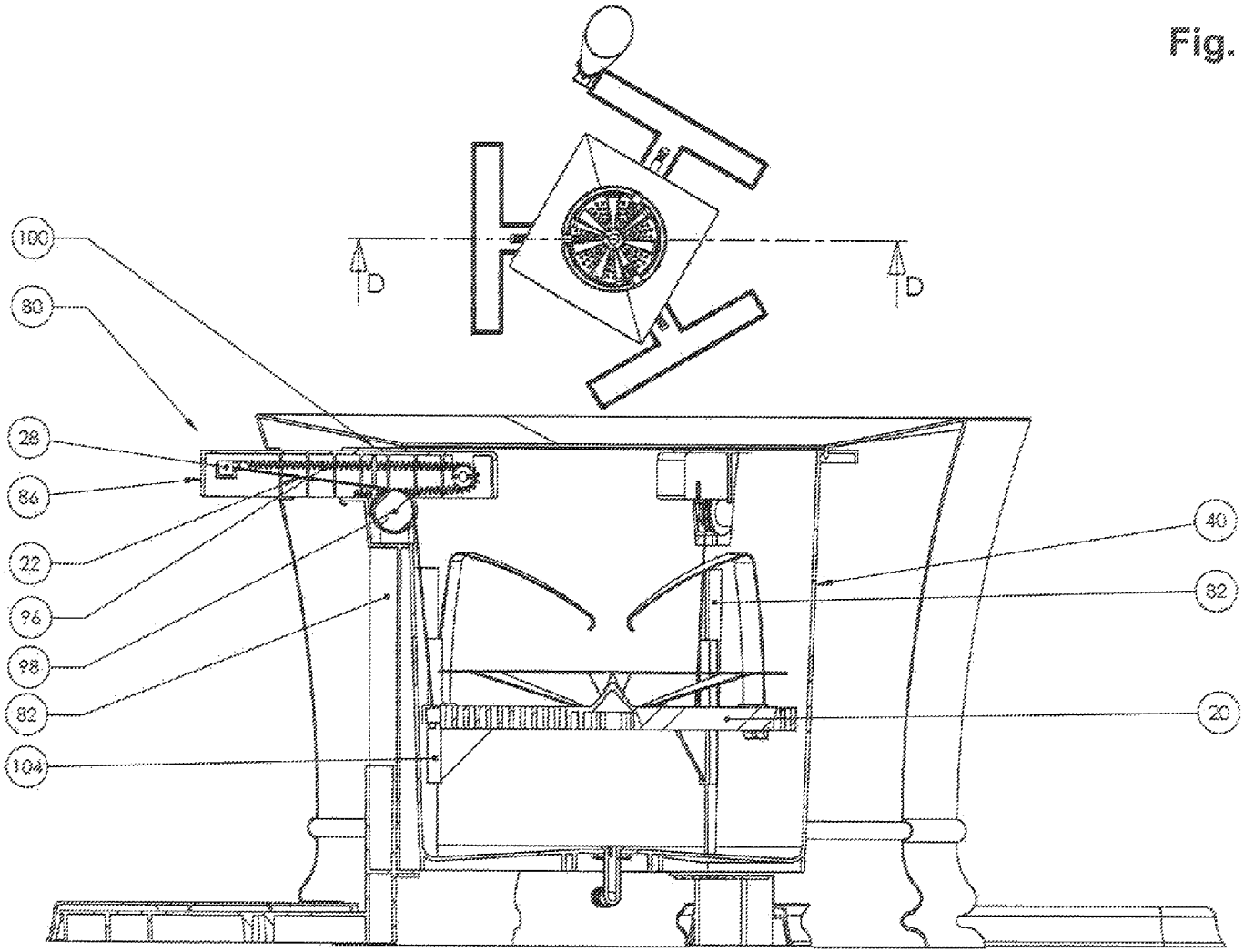
FIGS. 10 and 11 are different section views of a second embodiment of the present invention.
Figure 11:
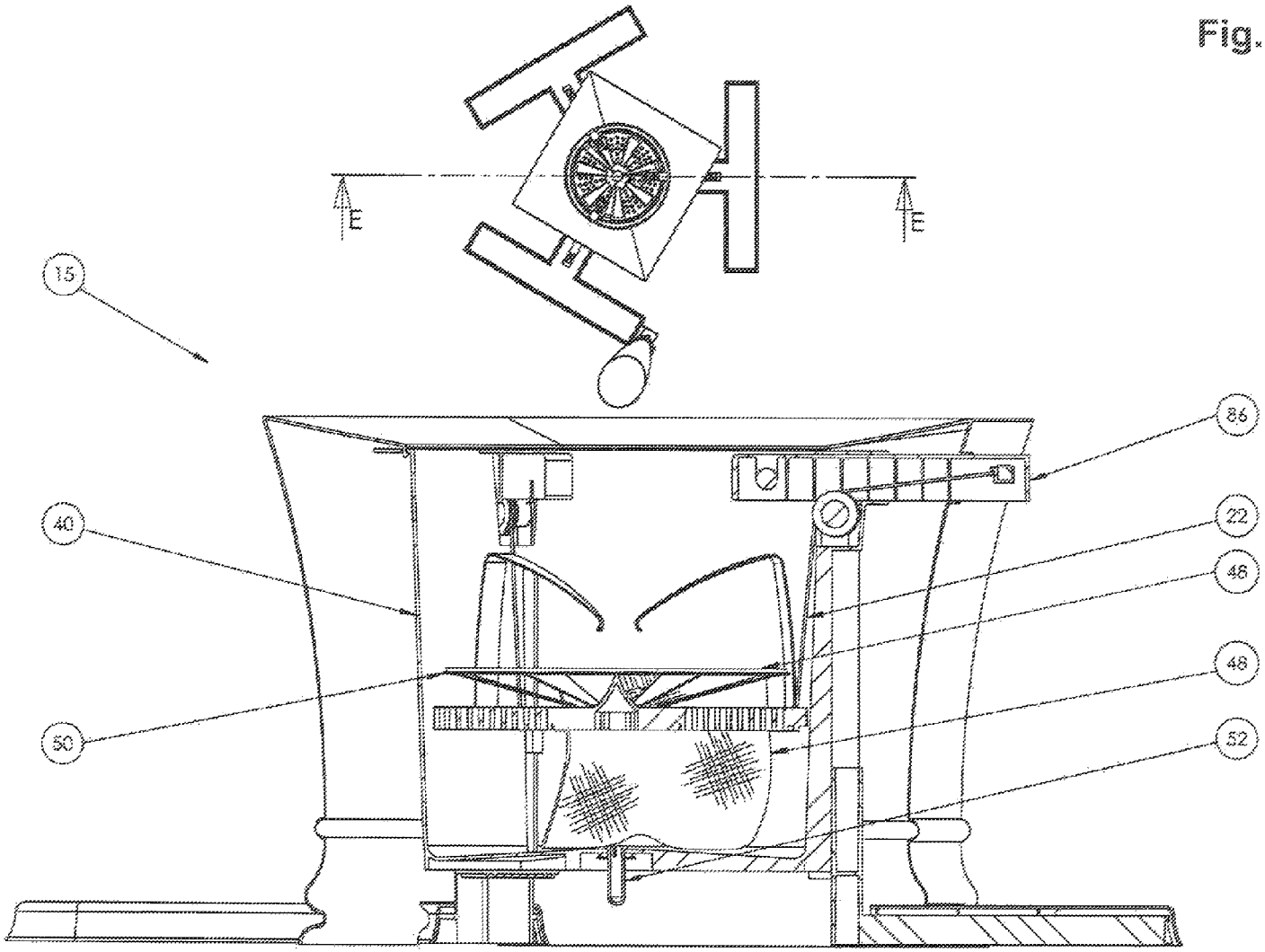

FIGS. 10 and 11 illustrate the second embodiment in cross section, showing various preferred components. The clamping mechanism 80 is depicted as having an unthreaded clamping arm 86, a return spring 96, the clamping cable 22 with cable ends 28 and a fixed pulley 98. These are located at the upper ends of the posts 82 that are attached to and extend upwardly from the base 84. The clamping mechanism 80 is movably engaged by the post 82 and an unthreaded clamping arm guide 100. The clamping mechanism 80 displaces the unthreaded clamping arm 86 until it engages with the substantially cylindrical element 1. FIG. 11 further depicts aspects of the liquid management system which can include the reservoir 40, a capillary mat and wick combination 48, a capillary mat spring 50, and a 90° hose plug 52. The liquid management system of the second embodiment can be substantially similar to the liquid management system of the first embodiment. In this illustration, the capillary mat and wick combination 48 is placed on top of the capillary mat spring 50 and hangs down into the reservoir in order to contact liquid therein.

Figure 12:
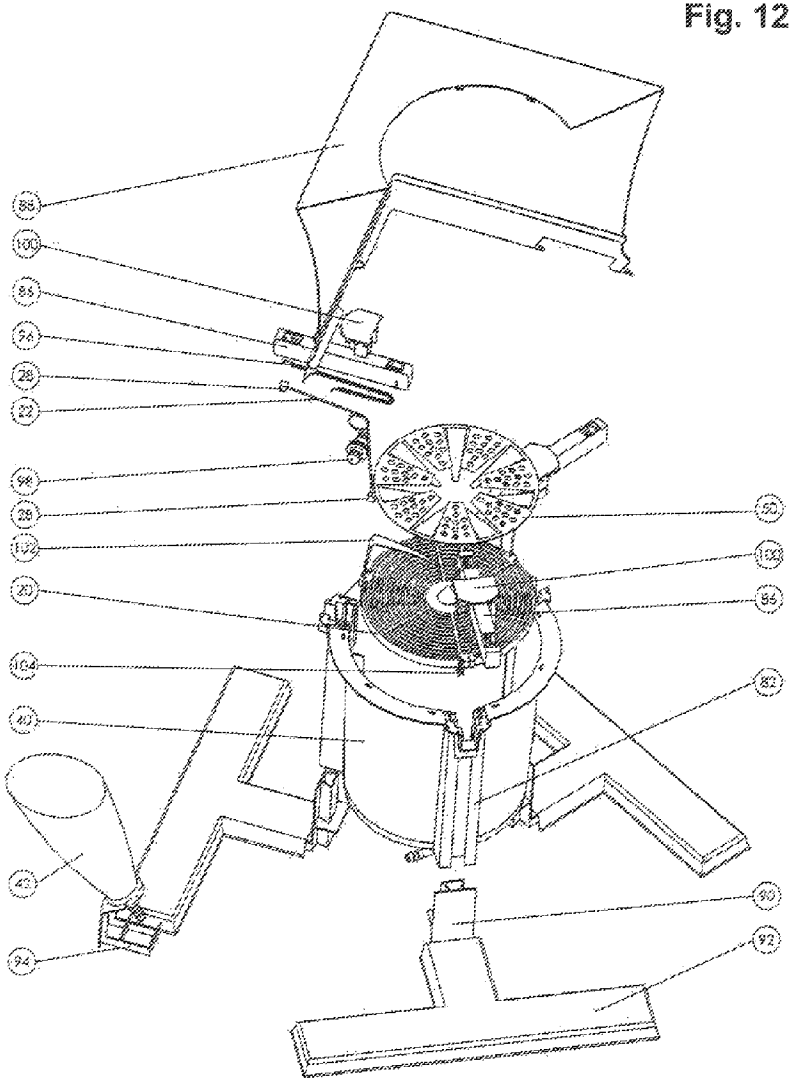
FIGS. 12 and 13 illustrate an exploded view of a second embodiment of the present invention.
Figure 13:
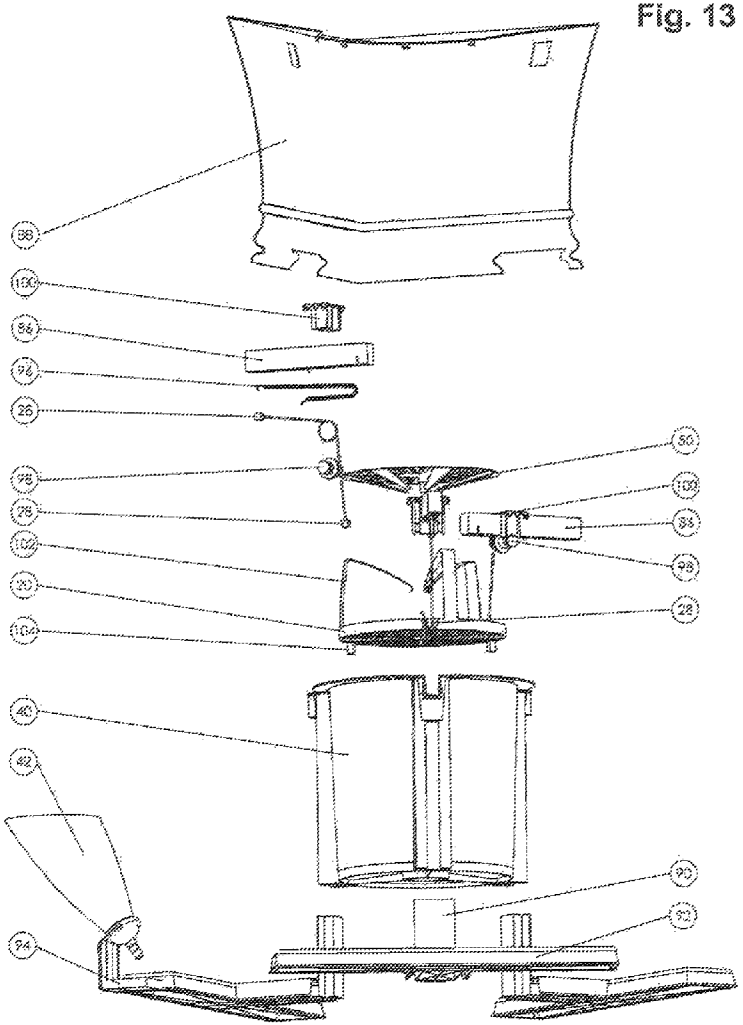

FIGS. 12 and 13 illustrate an exploded view of the self-adjusting apparatus of the second embodiment 78. In addition to the components listed above, FIGS. 12 and 13 depict a self-centering mechanism including a flexure spring 102 and gliders 104.

As in the description of the first embodiment, in operation, the unthreaded clamping arm 86 of the second embodiment is activated by the displacement of the retaining member 20. Such displacement is generated by the weight of the substantially cylindrical element 1 when it is placed on the retaining member 20. The clamping cable 22 transmits the force of the substantially cylindrical element 1, deposited on the retaining member 20, to the unthreaded clamping arm 86. The clamping cable 22 and the fixed pulley 96 convert the vertical movement of the retaining member 20 into radial movement of the unthreaded clamping arm 86 radially inward. The clamping cable 22 can be engaged with the retaining member by one of its cable end fittings 28 engaged with the side of the retaining member 20. The other cable fitting 28 can be lodged in the unthreaded clamping arm 86. When the retaining member 20 is displaced by the weight of the substantially cylindrical element 1, the unthreaded clamping arm 86 is displaced radially inward until it engages the substantially cylindrical element 1 that has been vertically placed within the opening defined by the posts 82.

A return spring 96 can be used to automatically return the apparatus to its starting position, or rest position, when weight is removed from the retaining member 20. The return spring 96 pulls the unthreaded clamping arm 86 radially outward while bringing the retaining member 20 to its highest position. The return spring 96 is preferably placed inside the unthreaded clamping arm 86 to prevent rust and save space inside the reservoir 40. The maximum ending position and clamping position of the second embodiment are defined in a similar manner as they are above for the first embodiment.

The clamping mechanism 80 is located at the upper end of the post 82 in the second embodiment and can be secured in place by the unthreaded clamping arm guide 100. Alternatively, the clamping mechanism can be placed elsewhere on the post. The fixed pulley 98 of the second embodiment does not turn. The clamping cable 22 slides circumferentially around the pulley 98 when the retaining member 20 is displaced. The friction generated between the clamping cable 22 and the fixed pulley 98 varies according to the tension on the clamping cable 22.

The clamping cable 22 circumscribes the pulley at least once, corresponding to a total winding angle of $\theta_t$. The substantially cylindrical element 1, sitting on the retaining member 20, applies tension to the clamping cable 22, pulling the unthreaded clamping arm 86 radially inward. As long as the retaining member 20 is moving and the unthreaded clamping arm 86 is not engaged with the substantially cylindrical element 1, the friction generated between the fixed pulley 98 and the clamping cable 22 is low enough that the mechanism remains moveable. When the unthreaded clamping arm 86 makes contact with the substantially cylindrical element, the tension in the clamping cable 22 increases. In this situation, the proper $\theta_t$ will deliver enough friction between the clamping cable 22 and the fixed pulley 98 to lock the mechanism. In this manner, the substantially cylindrical element is prevented from unclamping the substantially cylindrical element due to its weight on the retaining member 20, preventing it from moving relative to the self-adjusting apparatus. The effectiveness of this mechanism depends on $\theta_t$ and on the coefficient of friction ($\mu$) between the fixed pulley 98 and the clamping cable 22, according to Equation 2, which is an equation relating the equilibrium tensions between two portions of a cable wound around a pulley:

$$e^{-\mu\theta_t} = \frac{T_1}{T_2} = D \qquad \text{Equation 2}$$

Where:

e is a constant about equal to 2.71808183, $\mu$ is the coefficient of friction, $\theta_t$ is the total cable winding angle, $T_1$ is the tension in the portion of the cable 22 between the unthreaded clamping arm 86 and the fixed pulley 98, $T_2$ is the tension in the portion of the cable 22 between the fixed pulley 98 and the retaining member 20, and D is the ratio between $T_1$ and $T_2$.

In order to illustrate the meaning of this equation by numerical example, exemplary values are used for the different parameters. Hence, assuming a coefficient of friction ($\mu$) of 0.3, a total cable winding angle $\theta_t$ of 2 turns (12.5462 radians), and there are no external perturbing forces acting on the substantially cylindrical element, the equation returns:

$$e^{-0.3*12.5664} = \frac{T_1}{T_2} = D_0 = 0.023$$

This indicates that, with the parameter values used here, the tension between the unthreaded clamping arm 86 and the fixed pulley 98 is 0.023 times the tension between the fixed pulley 98 and the retaining member 20 when the substantially cylindrical element is not subjected to any external perturbation. Since the tension $T_2$ is proportional to the weight of the substantially cylindrical element, the force applied by the unthreaded clamping arm 86 on the substantially cylindrical element is substantially smaller than the force exerted by the substantially cylindrical element 1 on the retaining member 20. This allows the unthreaded clamping arm 86 to engage the substantially cylindrical element 1 without damaging the element. Exemplary values of $\mu$ and $\theta_t$ result in values of D between about 0.08 and about 0.00008 for various embodiments of the present invention.

In cases where the substantially cylindrical element is subjected to an externally applied horizontal force, the unthreaded clamping arm 86 will resist moving radially outward. This is due to the frictional force between the cable 22 and fixed pulley 98. Because the coefficient of friction ($\mu$) and the total cable winding angle ($\theta_t$) remain the same, increasing the tension $T_1$ by exerting an external force on the clamping arm 86 does not result in changes in $T_2$ until the friction between the cable 22 and fixed pulley 98 is overcome, that is to say, until the force on the unthreaded clamping arm 86 is 1/D times the weight of the element. Unlocking the presently preferred embodiment requires lifting the substantially cylindrical element 1 away from the surface of reference, thereby removing its weight from the retaining member 20. In cases where the externally applied horizontal force is sufficient to overcome the frictional force between the cable 22 and fixed pulley 98, once the externally applied force is removed, the clamping mechanisms 80 will clamp the substantially cylindrical element and return the element to a substantially vertical position.

Figure 14:
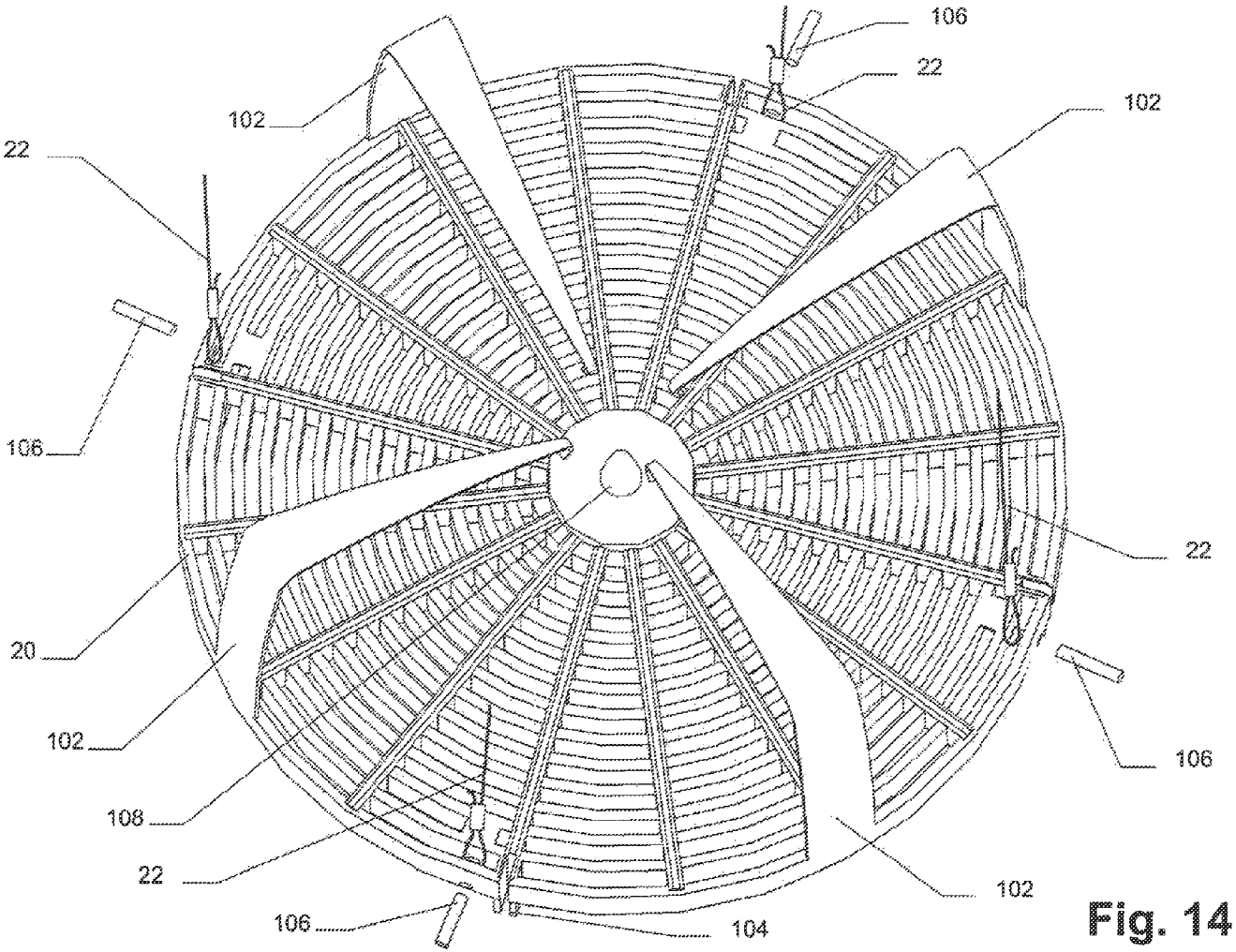
FIG. 14 illustrates a retaining member assembly and unwinding cables according to an embodiment of the present invention.

Both embodiments above describe a retaining member 20. One embodiment of the retaining member 20 is illustrated in FIG. 14. Similar to FIGS. 4 and 10, the retaining member 20 of FIG. 14 can be located inside the reservoir 40 and is preferably designed to be always concentric with the posts 14 or 82. In an embodiment, this concentric positioning is provided by the gliders 104 which interact with the posts 14 or 82. The gliders 104 allow the retaining member 20 only substantially vertical motion. At least two posts 14 or 82 and their corresponding grooves are preferably provided, which assures that the retaining member 20 is always substantially perpendicular to the posts 14 or 82. Although depicted as an inflexible mesh, in another embodiment, the retaining member can be provided as rigid body, such as: a flat tray, a frusto-conical platform, a bowl, etc.

The clamping cable 22 illustrated in FIG. 14 is joined to the retaining member 20 by a loop, which passes around a small rod 106 press-fitted in the retaining member 20. Alternatively, the clamping cable 22 can be engaged with the retaining member by means of the cable end fitting 28 or any other means commonly known in the art. The retaining member 20 depicted in FIG. 14 is shown to have a centering mechanism comprised of flexure springs 102 and a retaining member center pin 108.

The centering mechanism can help move a substantially cylindrical element 1 into a substantially vertical position. The centering mechanism can automatically center the substantially cylindrical element 1 just before it touches the retaining member center pin 108. To center the substantially cylindrical element 1 before it touches the retaining member center pin 108, a concentric spring action can be used to engage substantially cylindrical element 1.

The concentric spring action is provided by a flexure spring mechanism. In one embodiment, the flexure spring mechanism can have at least two flexure springs 102. The flexure springs 102 are preferably shaped to make contact with the substantially cylindrical element 1 and center it before it touches the retaining member center pin 108. Moreover, the shape of the flexure spring 102 is preferably designed such that the flexure spring 102 can have an increasing degree of stiffness the greater the diameter of the element being centered. This can make the flexure springs 102 deliver more centering force as the substantially cylindrical element's diameter increases. This can be desirable when centering large and heavy elements. In another embodiment, a single flexure spring has a single ring-type member that acts on the perimeter of the substantially cylindrical element. The substantially cylindrical element can be centered as it is lowered on to the retaining member 20, and engages with the retaining member center pin 108, the highest point of the retaining member.

The retaining member center pin 108 can prevent the substantially cylindrical element 1 from sliding on the surface of the retaining member 20, as illustrated in FIG. 15 where a tree is illustrated as being clamped in the self-adjusting apparatus 10 of the first embodiment. The self-adjusting apparatus 78 of the second embodiment can function in a similar manner when the retaining member 20 is the same in both embodiments. The retaining member center pin 108 securely retains the substantially cylindrical element 1. The retaining member center pin 108 can take the shape of a nail, a conical shape or any shape that has a narrow end, which could contact the base portion of the substantially cylindrical element 1. A parabolic or conically shaped center pin 108 can fit a hole of many different diameters preformed in the substantially cylindrical element. The embodiments described above can have one or more retaining member center pin(s) 108.

Rigid conical retaining members ensure that the substantially cylindrical element is centered at all times, even when not desired. The retaining member center pin 108 can also retain, in an off-center position, a substantially cylindrical element that would have been purposely pushed off-center by the user, against the flexure spring 102. Flexibility of the flexure spring 102 can, therefore, be desirable. Flexibility can be desirable when off-centering the substantially cylindrical element, such as in order to compensate for the curve or angular variation of a substantially cylindrical element that was crooked or curvy. This could be accomplished by off-centering the contact point between the substantially cylindrical element and the retaining member center pin 108, with the aim of clamping the substantially cylindrical element in a more generally vertical position.

The portion of the capillary mat 44 or capillary mat and wick combination 48, described previously, to contact the base of the substantially cylindrical element is preferably positioned so that it is at least as high as the retaining member center pin 108. The substantially cylindrical element's bottom can make contact with the capillary mat 44 or capillary mat and wick combination 48. The capillary mat 44 or capillary mat and wick combination 48 can be elevated to the desired height by the capillary mat spring 50. The capillary mat 44 or capillary mat and wick combination 48 are preferably somewhat cushioned.

Although the presently described embodiments refer to cable and pulley systems to link the retaining member 20 with the clamping mechanisms 12 and 80, other embodiments can have the retaining member activate the clamping mechanism through a gear and pinion system or any other system known in the art in which the clamping arms of the clamping mechanism move along a radial axis in order to clamp the substantially cylindrical element.

The above-described embodiments of the present invention are intended to be examples only. Alterations, modifications and variations may be effected to the particular embodiments by those of skill in the art without departing from the scope of the invention, which is defined solely by the claims appended hereto.

The invention claimed is:

1. A self-adjusting apparatus for holding a substantially cylindrical element in a substantially vertical position with respect to a surface of reference, the self-adjusting apparatus comprising:

a base for placement on the surface of reference;

a receiving chamber attached to and extending upwardly from the base to define a receiving area for receiving the substantially cylindrical element, the receiving chamber defining an opening at an upper edge thereof;

a retaining member for retaining a lower portion of the substantially cylindrical element within the receiving area, the retaining member disposed within the receiving area and below the opening and being vertically movable in response to receiving the substantially cylindrical element;

a plurality of clamping mechanisms, each clamping mechanism coupled to the receiving chamber, and including:

a clamping arm above the retaining member; and a cable system operatively connecting the clamping arm to the retaining member to automatically move the clamping arm from a rest position to a clamping position in response to downward vertical displacement of the retaining member, to clamp the substantially cylindrical element in the substantially vertical position.

2. The self-adjusting apparatus according to claim 1, wherein at least one of the plurality of clamping mechanisms further comprises:

at least one fixed element in physical communication with, and exerting a frictional force on, the cable system;

wherein the clamping arm exerts a clamping force, which is reduced by the frictional force, on the substantially cylindrical element, the clamping force being proportional to the downward force of the substantially cylindrical element on the retaining member, the downward force being due to the weight of the substantially cylindrical element.

3. The self-adjusting apparatus according to claim 2, wherein the fixed element is a fixed pulley.

4. The self-adjusting apparatus according to claim 2, wherein the clamping force is reduced to between about 0.002 and about 0.6 times the weight of the substantially cylindrical element on the retaining member.

5. The self-adjusting apparatus according to claim 2, wherein the fixed element exerts a variable frictional force on the cable system.

6. The self-adjusting apparatus according to claim 1, further comprising a flexure spring mechanism to center the substantially cylindrical element within the opening.

7. The self-adjusting apparatus according to claim 1, wherein the clamping arm is moveable along a radial axis, the axis being below the opening and above the retaining member; and the clamping arm moves along the radial axis in response to the downward vertical displacement of the retaining member.

8. The self-adjusting apparatus according to claim 1, wherein, in the absence of an externally applied force, the clamping arm exerts a clamping force on the substantially cylindrical element that is directly proportional to the weight of the substantially cylindrical element.

9. The self-adjusting apparatus according to claim 1, wherein, in the absence of an externally applied force and for a given weight of the substantially cylindrical element, the clamping arm exerts a substantially constant clamping force on the substantially cylindrical element irrespective of the clamping position.

10. The self-adjusting apparatus according to claim 8, wherein the clamping force is less than or equal to a downward force due to the weight of the substantially cylindrical element on the retaining member.

11. The self-adjusting apparatus according to claim 8, wherein the clamping force is between about 0.002 and about 0.6 times the weight of the substantially cylindrical element on the retaining member.

12. The self-adjusting apparatus according to claim 1, wherein the clamping mechanism includes two cooperating elements exerting a variable frictional force on each other to prevent the clamping mechanism from unclamping in response to a substantially horizontal external force applied to the substantially cylindrical element.

13. The self-adjusting apparatus according to claim 12, wherein the clamping arm is a threaded clamping arm and the clamping mechanism further includes a threaded cylinder, the frictional force being between the threaded clamping arm and the threaded cylinder.

14. The self-adjusting apparatus according to claim 13, wherein the cable system includes a cable under tension and the frictional force prevents the external force from affecting the magnitude of tension in the cable.

15. The self-adjusting apparatus according to claim 12, wherein: the clamping arm is an unthreaded clamping arm; the cable system includes a cable and a fixed pulley; and the frictional force is between the cable and the fixed pulley.

16. The self-adjusting apparatus according to claim 15, wherein: the cable system further includes a first tension (T1) in a portion of the cable between the unthreaded clamping arm and the fixed pulley; a second tension (T2) in a portion of the cable between the fixed pulley and the retaining member; and the ratio between the first tension and second tension (T1/T2) is between about 0.08 and about 0.00008.

17. The self-adjusting apparatus according to claim 1, wherein the clamping mechanism further comprises a geared transmission to achieve a desired amount of radial displacement of the clamping arm as a function of the amount of vertical displacement of the retaining member.

18. The self-adjusting apparatus according to claim 17, wherein the desired amount of radial displacement of the clamping arm is between about 0.8 and about 1.2 times the vertical displacement of the retaining member.

19. The self-adjusting apparatus according to claim 1 wherein the self-adjusting apparatus further comprises a liquid management system including a reservoir disposed below the opening and within the receiving area.

20. The self-adjusting apparatus according to claim 19, further comprising a funnel in liquid communication with the reservoir for filling the reservoir with liquid.

21. The self-adjusting apparatus according to claim 19, further comprising a means for indicating the level of liquid in the reservoir.

22. The self-adjusting apparatus according to claim 19, further comprising a capillary system for drawing liquid from a lower portion of the reservoir up to a portion of the reservoir above the retaining member when the level of liquid in the reservoir is below the retaining member.

23. A self-adjusting apparatus for holding a substantially cylindrical element in a substantially vertical position with respect to a surface of reference, the self-adjusting apparatus comprising:

a base for placement on the surface of reference;

a plurality of posts, each post attached to and extending upwardly from the base to define a receiving area for receiving the substantially cylindrical element, the receiving area defining an opening between upper ends of the plurality of posts;

a retaining member for retaining a lower portion of the substantially cylindrical element within the receiving area, the retaining member disposed within the receiving area and below the opening and being vertically movable in response to receiving the substantially cylindrical element;

a plurality of clamping mechanisms, each clamping mechanism coupled to one of the plurality of posts, and including:

a clamping arm above the retaining member; and a cable system operatively connecting the clamping arm to the retaining member to automatically move the clamping arm from a rest position to a clamping position in response to downward vertical displacement of the retaining member, to clamp the substantially cylindrical element in the substantially vertical position.

* * * * *